United States Patent [19]

Kaji

[11] Patent Number: 4,786,249

[45] Date of Patent: Nov. 22, 1988

[54] SPRING HEAT TREATING FURNACE

[75] Inventor: Kazumi Kaji, Osaka, Japan

[73] Assignees: Kabushiki Kaisha Asada, Tokyo; Coil Master Kogyo Kabushiki Kaisha, Osaka, both of Japan; part interest to each

[21] Appl. No.: 84,992

[22] Filed: Aug. 13, 1987

[30] Foreign Application Priority Data

Nov. 11, 1986 [JP] Japan ..... 61-173836[U]

[51] Int. Cl.[4] ..... F27B 9/14

[52] U.S. Cl. ..... 432/121; 432/134; 432/247; 432/249; 34/164

[58] Field of Search ..... 432/239, 249, 247, 134, 432/121; 34/164

[56] References Cited

U.S. PATENT DOCUMENTS 4,035,151 7/1977 Czerny et al. ..... 432/134
4,048,472 9/1977 Sauer et al. ..... 432/134
4,255,129 3/1981 Reed et al. ..... 432/134
4,582,484 4/1986 Sandor ..... 432/134
4,640,683 2/1987 Mori ..... 432/134

*Primary Examiner*—Henry C. Yuen
*Attorney, Agent, or Firm*—Ladas & Parry

[57] ABSTRACT

A spring heat treating furnace in which untreated springs are charged through a charging port in the body thereof, the springs being heat-treated while being conveyed along a conveyance passageway inside the body. The heat-treated springs are discharged from a discharge port in the furnace body, said conveyance passageway being formed into a spiral passageway capable of arranging said springs in the direction of conveyance. A passageway vibrating device is disposed at the lower portion of said conveyance passageway for vibrating the passageway to convey the springs in a discharging direction.

10 Claims, 6 Drawing Sheets

SPRING HEAT TREATING FURNACE

FIELD OF THE INVENTION

This invention relates to a spring heat treating furnace in which untreated springs comprising wires formed into coils are heat-treated to remove residual stress at molding, thereby forming springs for tensioning or compressing purposes.

BACKGROUND OF THE INVENTION

When untreated springs of the above-described types are subjected to heat treatment, as shown in FIG. 8 by way of example, springs are charged from the upper portion of a furnace body of cylindrical form and are heat-treated while flowing downwardly along a conveyance passageway formed as a vertically extending helix on the inner peripheral surface of the furnace body. The heat-treated springs are discharged from the lower portion of the furnace body.

However, since the conveyance passageway is formed to have a large width so as to smoothen the downward flow of the springs, there are cases where the springs contact the wall surfaces of the conveyance passageway or become entangled with one another in the course of their downward flow due to the longitudinal and transverse attitude of the springs during their downward flow through the conveyance passageway. In consequence, the downward flow speed of the springs becomes irregular. When the downward flow speed is too low, overheating results; when too high, heat treatment is insufficient. In other words, the problem that results is that the heat treatment cannot be performed uniformly.

In order for the aforementioned heat treatment to be carried out for a rquired, sufficient amount of time, it is necessary that the conveyance passagway have a certain length. Therefore, the conveyance passageway of the required length is formed on the inner peripheral surface of the abovementioned furnace body. When this is done, the furnace body is increased in vertical length since the conveyance passageway is so formed as to have a number of loops vertically along the inner peripheral surface of the furnace body.

As a result of the foregoing, the heat used in the treatment comes to reside solely in the upper region of the furnace body. Consequently, the temperature distribution within the furnace is such that the upper region becomes high in temperature while the lower region drops in temperature, resulting in a prounouced temperature difference. Accordingly, the springs which flow down into the lower region are not sufficiently heat-treated. Thus, one problem is that a satisfactory heat treatment cannot be carried out. Another is that the furnace body is large in size.

BRIEF SUMMARY OF THE INVENTION

The primary object of this invention is to provide a spring heat treating furnace in which a spirally shaped conveyance passageway formed inside a furnace body is vibrated to convey untreated springs, thereby reliably preventing the springs from entangling and piling up so that the springs charged into the furnace may be heat-treated uniformly, and in which a long conveyance passageway can be formed while reducing the size of the furnace body, thereby allowing a highly efficient heat treatment to be carried out.

The invention is characterized by a spring heat treating furnace in which a conveyance passageway formed inside a furnace body is formed into a spiral passageway capable of arranging untreated springs in the direction of conveyance, and in which a passageway vibrating device is disposed at the lower portion of the conveyance passageway for vibrating the passageway to convey the springs in a discharging direction.

According to the invention, the spiral conveyance passageway inside the furnace body is vibrated by the passageway vibrating device and untreated springs charged into the conveyance passageway are conveyed in the discharging direction.

In accordance with the invention, the spiral conveyance passageway has a planar configuration, so that the furnace body can be reduced in size despite the fact that a long conveyance passageway is formed inside the furnace body. Moreover, if the springs are imparted with a predetermined spacing when they are charged into the furnace, the conveying force acting upon the springs will be constant at all positions along the conveyance passageway, so that the springs can be conveyed at a predetermined spacing. As a result, the springs charged into the furnace are heat-treated uniformly. This makes it possible to form springs for e. g. tensioning or compressing purposes and, at the same time, to reliably prevent the entangling and piling up of springs in the passageway.

Further, if plural levels of the conveyance passageway are formed inside the furnace body, the conveyance passageway of an upper level and the conveyance passageway of the underlying level can be connected to form a single passageway. Thus, the passageway can be extended in length by both the number of loops in each conveyance passageway and the number of levels thereof, without increasing the size of the above-described furnace body. Moreover, even if the conveyance speed is raised, a suffficient heat treatment can be performed because of the length of the passageway. At the same time, entanglement can be realiably prevented by widening the spring spacing during conveyance. Since the furnace body is small in size, a highly efficient heat treatment can be carried out.

DETAILED DESCRIPTION OF THE INVENTION

[Most Preferable Embodiment]

An embodiment of the invention will now be described in detail in conjunction with the drawings.

Figure 1:
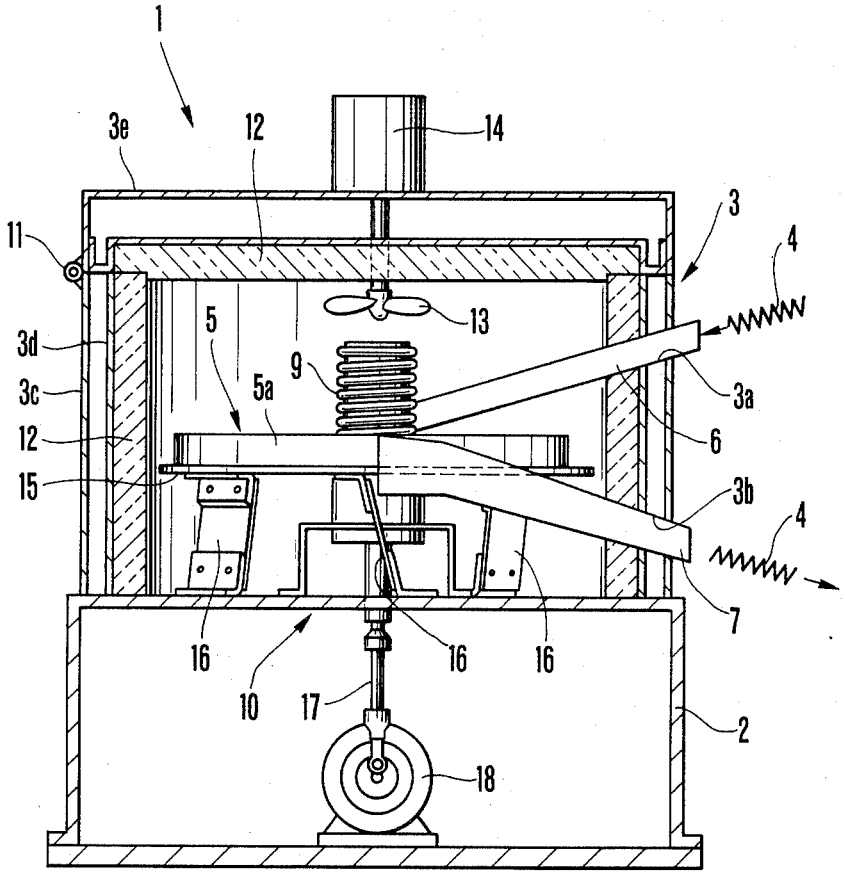
FIG. 1 is a longitudinal sectional side view of a spring heat treating furnace.
Figure 2:
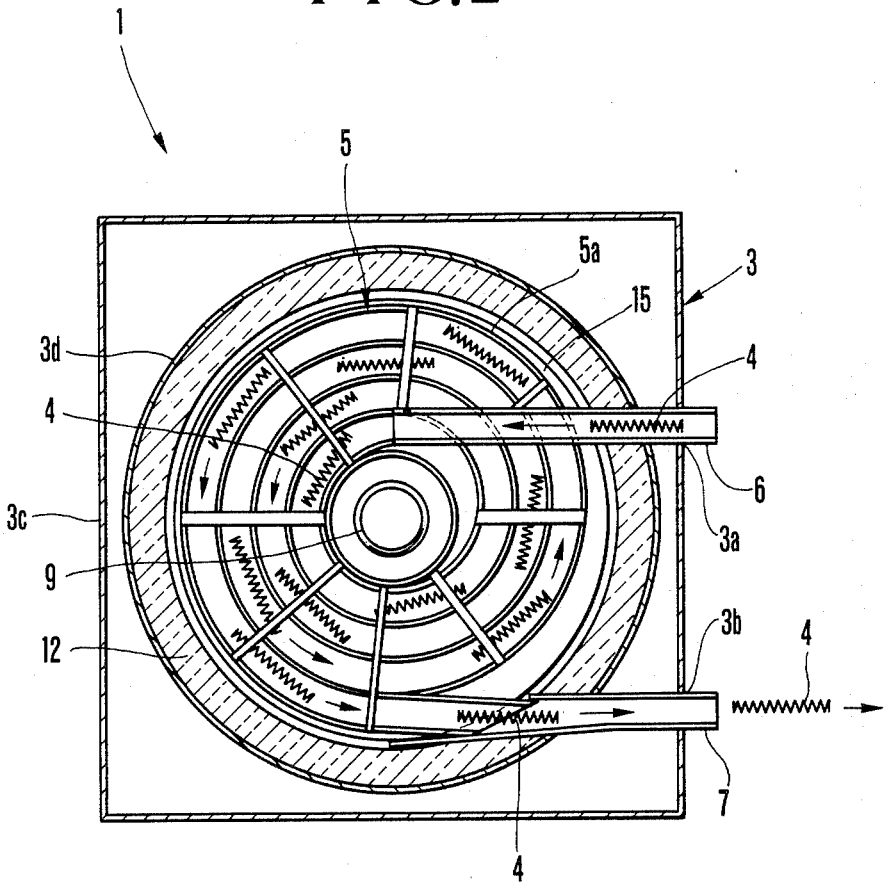
FIG. 2 is a transverse sectional plan view of the spring heat treating furnace.

The drawings illustrate a spring heat treating furnace for forming springs by a heat treatment. In FIGS. 1 and 2, a spring heat treating furnace includes a cylindrical furnace body 3 secured to the upper portion of a base 2, and a spiral conveyance passageway 5 for charging untreated springs 4 formed inside the furnace. A charging port 3*a* formed in the furnace body 3 for charging the untreating springs 4 is connected to the starting end at the center of the conveyance passageway 5 via a supply passage 6. A discharge part 3*b* for discharging the heat-treated springs 4 is connected to the terminal end of the passageway at the outer loop thereof. A cylindrical heater 9 is erected at the central portion of the conveyance passageway 5, and a passageway vibrating device 10 for vibrating the conveyance passageway 5 is arranged at the lower portion of the passageway.

As shown in FIG. 1, the furnace body 3 has an outer frame 3*c* of box-shaped form the interior of which houses a cylindrical frame 3*d* having the form of a circular cylinder. A cover 3*e* for sealing the opening at the upper portion of the cylindrical frame 3*d* is pivoted via a hinge 11 on the upper portion of the outer frame 3*c* so as to be capable of freely opening and closing. An adiabatic material 12 is fixed between the inner peripheral surface of the cylindrical frame 3*d* and the inner surface of the cover 3*e*.

A fan 13 is rotatably mounted at the central portion of cover 3*e* on the inner surface thereof and has its rotation controlled by a motor 14 secured on the upper surface of the cover 3*e*.

Figure 3:
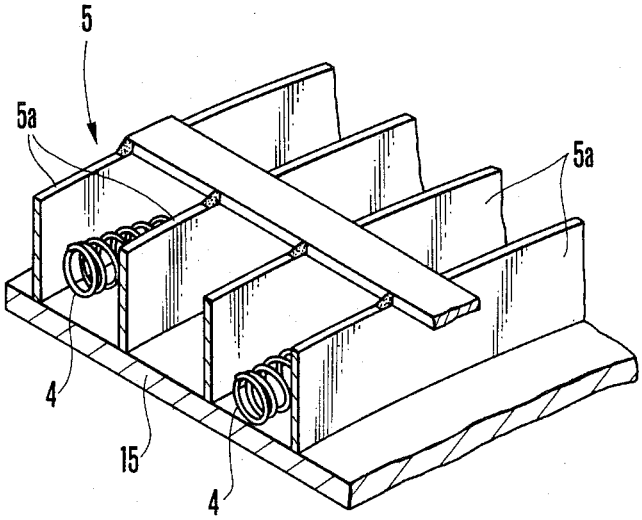
FIG. 3 is a partial enlarged perspective view of a conveyance passageway.
Figure 4:
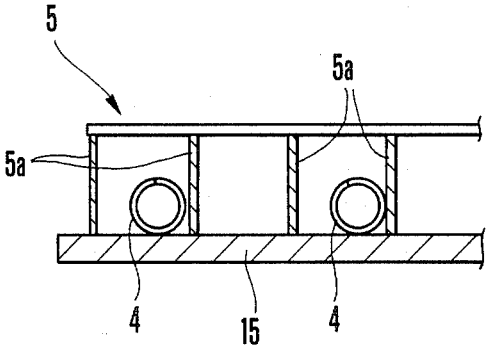
FIG. 4 is a longitudinal sectional view of the conveyance passageway shown in FIG. 3.

As shown in FIGS. 3 and 4, the conveyance passageway 5 includes a stainless steel circular plate 15 supported horizontally in the interior of the furnace body 3. A stainless steel strip 5a coiled into a spiral is welded on the upper suraface of the circular plate 15 and has a width slghtly greater than the outer diameter of the springs 4. The strip forms a passageway of constant width capable of conveying the springs 4 in an aligned state.

As shown in FIG. 1. the circular plate 15 is supported horizontally by three support plates 16 secured to the lower surface thereof. The support plates 16 incline slightly in the same direction with their upper ends being secured to positions on the lower surface of the circular plate 15 that divide the circumference thereof into three equal portions and their lower ends being secured to the base 2. The support plates are secured in a state they are capable of flexing slightly in the circumferential direction of the circular plate 15.

The passageway vibrating device 10 has a support rod 17 pivotally secured to the lower surface of the circular plate 15 at the central portion thereof, and a drive motor 18 underlying the base 2. The lower end portion of the support rod 17 is pivotally connected to a drive motor 18 at an eccentric position with respect to the motor rotary shaft.

Use of the spring treating furnace 1 thus constructed will now be described.

The power supply of the furnace body 3 is turned on to rotate the fan 13 mounted on the cover 3*e*, thereby agitating the hot air from the heater 9 to uniformly heat the interior of the furnace body 3. The drive motor 18 underlying the base 2 is also started in order to vibrate the conveyance passageway 5.

This is followed by continuously charging the untreated springs 4, which have been cut to predetermined lengths, from the charging port 3*a* of furnace body 3 into the centrally located starting end of the conveyance passageway 5 at a fixed spacing via the supply passage 6.

Meanwhile, the entirety of the conveyance passageway 5 into which the springs 4 are charged is vibrated by the vertical movement of the circular plate 15 to which the support rod 17 is pivotally attached. The vertical movement is caused by the up-and-down movement of the support rod 17 resulting from rotation of the drive motor 18.

More specifically, when the circular plate 15 is pulled downward by the downward motion of the support rod 17, the support plates 16 flex slightly circumferentially of the circular plate 15, thereby rotating the entirety of the conveyance passageway slghtly in the horizontal direction. Owing to the upward stroke of the support rod 17, the support plates 16 return to their original inclined attitudes, so that the conveyance passageway 4 is rotated slightly in the direction opposite that caused by the downward stroke. By repeating this operation in continuous fashion, the springs 4 charged into the conveyance passageway 5 are conveyed in an aligned state toward the end of the passageway.

During conveyance, the springs are heat-treated by the heater 9 and travel while maintaining the spacing at which they were introduced. The heat-treated springs 4 are discharged from the discharge port 3*b* of furnace body 3 via the discharge passage 7 provided at the terminal end of the conveyance passageway 5.

Since the spiral-shaped conveyance passageway 5 is formed in a plane, the furnace body 3 can be reduced in size despite the fact that the lengthy conveyance passageway 5 is formed inside the furnace body 3. Moreover, since the conveying force acting upon the springs 4 is constant at all positions along the conveyance passageway 5, the springs 4 can be conveyed while a constant spacing is maintained among them. As a result, the charged springs 4 are heat-treated uniformly and entangling thereof within the passageway can be reliably prevented. Furthermore, since the furnace body 3 is compact in size, the temperature within the furnace can be made uniform with ease, thereby allowing a highly efficient heat treatment to take place.

Figure 5:
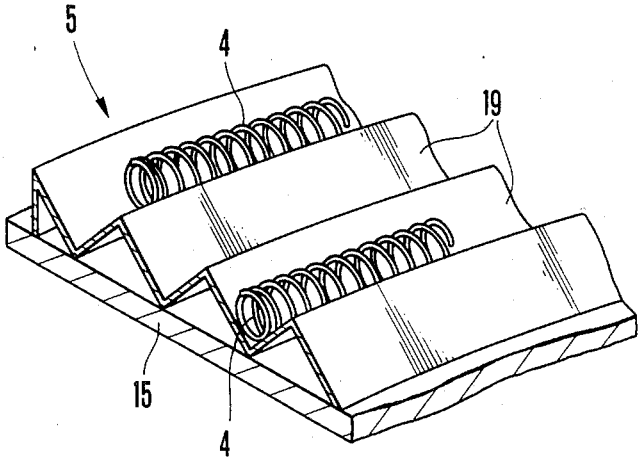
FIG. 5 is a partial enlarged perspective view of a conveyance passageway illustrating another example.
Figure 6:
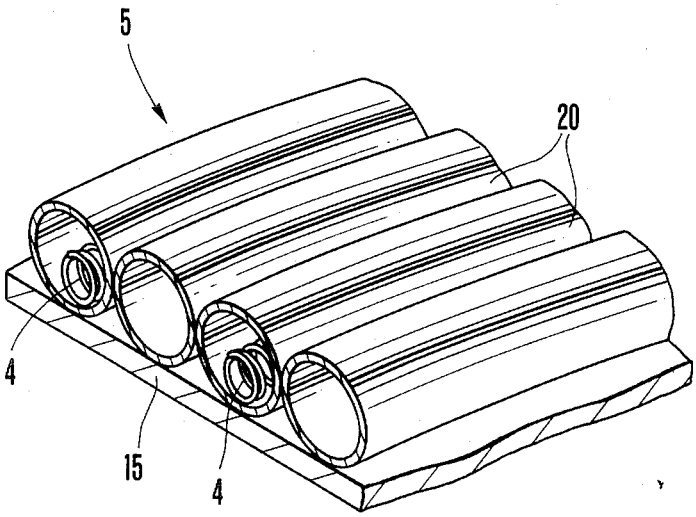
FIG. 6 is a partial enlarged perspective view of a conveyance passageway illustrating still another example.

As shown in FIG. 5, a conveyance disk 19 having a spirally formed V-shaped groove can be placed on the circular plate 15 or, as shown in FIG. 6, a pipe 20 having a diameter slightly larger than that of the springs 4 can be wound into a coil to form the conveyance passageway 5. Both of these arrangements enable uniform heat treatment of the springs 4 just as in the above-described embodiment. They also position the springs 4 in the center of the passageway at all times, so that entangling of the springs in the passageway can be prevented with assurance.

[Another Embodiment]

Figure 7:
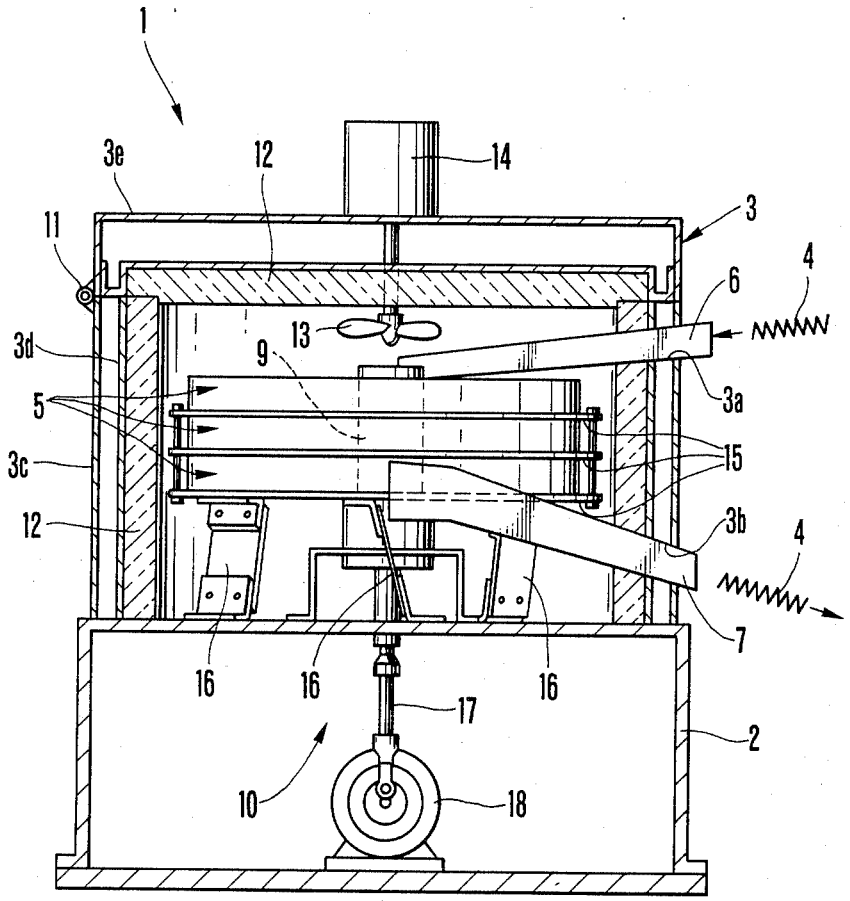
FIG. 7 is a longitudinal sectional side view of a spring heat treating furnace illustrating another embodiment of the present invention.
Figure 8:
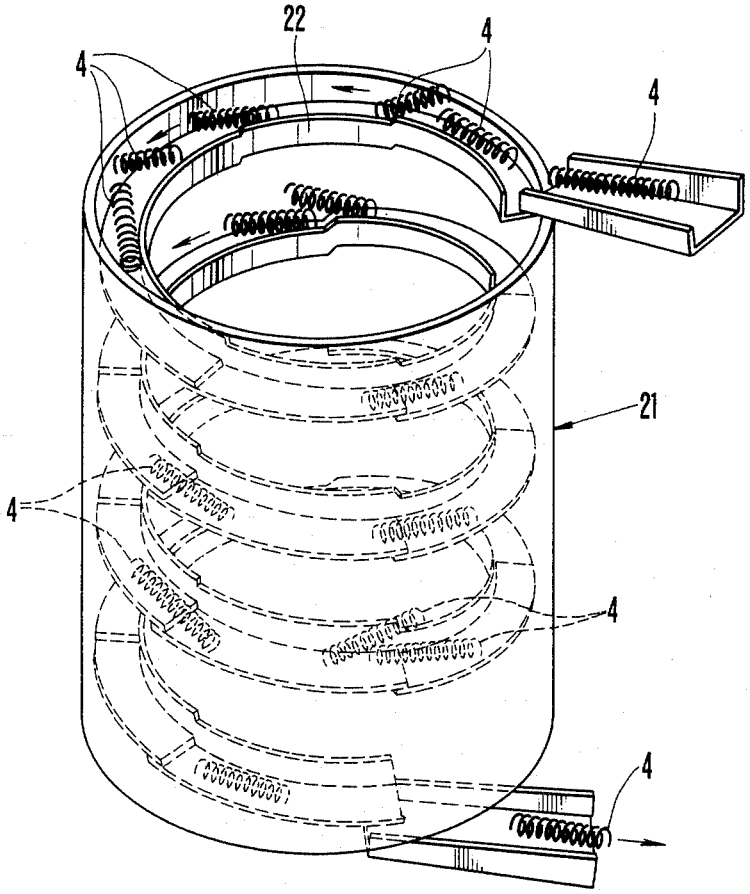
PRIOR ART FIG.8
FIG. 8 is a perspective view of a spring heat treating furnace illustrating an example of the prior art.

FIG. 7 illustrates another embodiment of the present invention, in which plural levels of the conveyance passageway 5 are formed inside the furnace body 3 of the foregoing embodiment. In this case, the conveyance passageway 5 of a lower level is formed into a spiral which is the reverse of the overlying level, and the terminal end of the conveyance passageway 5 of an upper level is connected to the starting end of the conveyance passageway of the underlying level. Thus, the passageway can be extended in length by both the number of loops in each conveyance passageway 5 and the number of levels thereof, without increasing the size of the above-described furnace body 3. Moreover, even if the speed at which the springs 4 are conveyed is raised, a sufficient heat treatment can be performed because of the length of the passageway. At the same time, entanglement can be reliably prevented by widening the conveyance spacing at the front and rear or each spring.

It should be noted that the present invention is not limited solely to the construction of the embodiments.

I claim:

1. A spring heat treating furnace defining a charge port and a discharge port and comprised of:

heating means;

disk-like conveyance means associated with said heating means and defining in a plane a spiral conveyance passageway having a starting end near the center of said passageway and a terminal end at the outermost periphery of said passageway said ends being located generally in the same plane as said passageway, said passageway being associated with said charging port and said discharging port; and vibrating means for vibrating said passageway, such that untreated springs pass through said charge port to said passageway and are vibrated in a plane along the spiral of said passageway to said discharge port.

2. The furnace of claim 1 wherein said charge port is generally adjacent said starting end and said heating means such that said untreated springs are carried to said starting end of said passageway near said heating means and then by vibration from said vibrating means moved further and further away from said heating means toward said terminal end of said passageway and said charge port, said heating means lying generally centrally of said passageway.

3. The furnace of claim 2 wherein said discharge port is generally adjacent the outer circumference of said passageway and said terminal end.

4. The furnace of claim 2 wherein said passageway is defined in a horizontal plane.

5. The furnace of claim 1 wherein said passageway is a first spiral conveyance passageway and wherein said furnace comprises a second spiral conveyance passageway located atop said first passageway and generally surrounding said heating means, said second spiral being the reverse of said first spiral such that said terminal end of said second spiral communicates with said starting end of said first spiral so that the conveying surface defined by said passageways can be extended in length both by the number of loops in each spiral of each passageway and the number of passageways placed on top of one another.

6. The furnace of claim 2 wherein said vibrating means is comprised of:

a rod located generally centrally of said passageway;

a motor having a rotary shaft onto which said rod is eccentrically attached; and circumferentially flexible support plates secured to said passageway about said rod such that said rod moves said passageway up and down along a first plane normal to the plane of said passageway, and said plates move said passageway from side to side parallel to the plane of said passageway.

7. The furnace of claim 2 further comprising a fan for circulating the heat from said heating means in said furnace.

8. The furnace of claim 2 wherein the passageway is vshaped.

9. The furnace of claim 2 wherein the passageway is tubular.

10. The furnace of claim 1 wherein the passageway approximates the diameter of said springs.

* * * * *